United States Patent [19]

Hacking

[11] 4,263,844

[45] Apr. 28, 1981

[54] APPARATUS FOR STACKING AND COMPRESSING BATTS

[75] Inventor: Vern Hacking, Kitchener, Canada

[73] Assignee: Patco Packing Limited, Sarnia, Canada

[21] Appl. No.: 55,064

[22] Filed: Jul. 5, 1979

[51] Int. Cl.[3] ..... B30B 15/30

[52] U.S. Cl. ..... 100/215; 53/529; 100/226

[58] Field of Search ..... 100/215, 226; 53/529, 53/530

[56] References Cited

U.S. PATENT DOCUMENTS

| | | | |
|---|---|---|---|
| 3,908,539 | 9/1975 | O'Brien | 100/215 X |
| 3,977,155 | 8/1976 | Spaulding | 100/226 X |
| 4,040,230 | 8/1977 | Pessel | 100/215 |
| 4,094,130 | 6/1978 | Kelly | 100/215 X |
| 4,099,363 | 7/1978 | Wistinghausen | 100/226 X |

*Primary Examiner*—Billy J. Wilhite

*Attorney, Agent, or Firm*—Fetherstonhaugh & Co.

[57] ABSTRACT

A load arresting station is provided in an apparatus for stacking and compressing batts of compressible material which includes a removable platform on which batts are supported and front and back stop walls for arresting the forward motion and recoil motion of batts driven into the load arresting station along a generally horizontal path.

2 Claims, 4 Drawing Figures

APPARATUS FOR STACKING AND COMPRESSING BATTS

FIELD OF INVENTION

This invention relates to improvements in apparatus for stacking and compressing batts of compressible material.

PRIOR ART

Considerable difficulty has been experienced in attempting to load batts of compressible material such as glass fiber insulation into a packaging machine.

An apparatus suitable for use in automatically stacking and compressing batts of compressible material is described in Canadian Pat. No. 1,013,378, issued to Patco Packing Limited, dated July 5, 1977. In this apparatus, batts are loaded into a loading accumulating chamber and are subsequently driven downwardly into a load compression chamber. The present invention is directed to an improvement in an apparatus of this type which serves to bring the batts to rest in a load arresting station disposed above the load accumulating station. The load arresting station is arranged so as to ensure that the batts are correctly aligned with the load accumulating station before being permitted to fall under the influence of gravity into the load accumulating station.

It has been found that because batts are "shot" into the stacking chamber along a feed path which opens laterally into the chamber it is necessary to bring the batts to rest in a position disposed in a generally horizontal plane before permitting the batts to fall under the influence of gravity into the load accumulating station to ensure that the batts are arranged one directly above the other when in the load accumulating station. If the batts are misaligned longitudinally, considerable difficulty is experienced in attempting to compress the misaligned batts into the configuration required for packaging.

The present invention overcomes the difficulties previously encountered in attempting to package compressible batts by providing a load arresting station which includes a removable platform on which batts are supported and front and back stop walls for arresting the foward motion and recoil motion of batts driven into the load arresting station along a generally horizontal path.

SUMMARY OF INVENTION

According to one aspect of the present invention, there is provided in an apparatus for stacking and compressing batts of compressible material which includes a vertically oriented stacking chamber having a front wall, back wall and a pair of oppositely disposed side walls, the improvement of a pair of gates mounted one on each side wall, each gate being mounted for movement between a first position extending laterally from the side wall on which it is mounted into the stacking chamber in a first plane to prevent the passage of batts downwardly through the stacking chamber and a second position in which said gates are withdrawn from said chamber to permit batts to fall freely through said stacking chamber, drive means mounted on said side walls and engaging said gates, said drive means being operable to move said gates to and fro between said extended and retracted positions, an input passage opening through said back wall at a level above said first plane for admitting batts to said chamber along a generally horizontal path which extends toward said front wall, said front wall including a front stop extending above said first plane and disposed opposite said input passage to provide a stop against which batts are driven when loaded into said chamber through said input passage, stationary back stop means at said back wall extending upwardly from said first plane to said input passage to form a back stop to prevent recoil ejection of batts from said chamber through said input passage, means for feeding batts at high speed along said path and through said input passage means in use.

PREFERRED EMBODIMENT

The invention will be more clearly understood after reference to the following detailed specification read in conjunction with the drawings, wherein.

Figure 1:
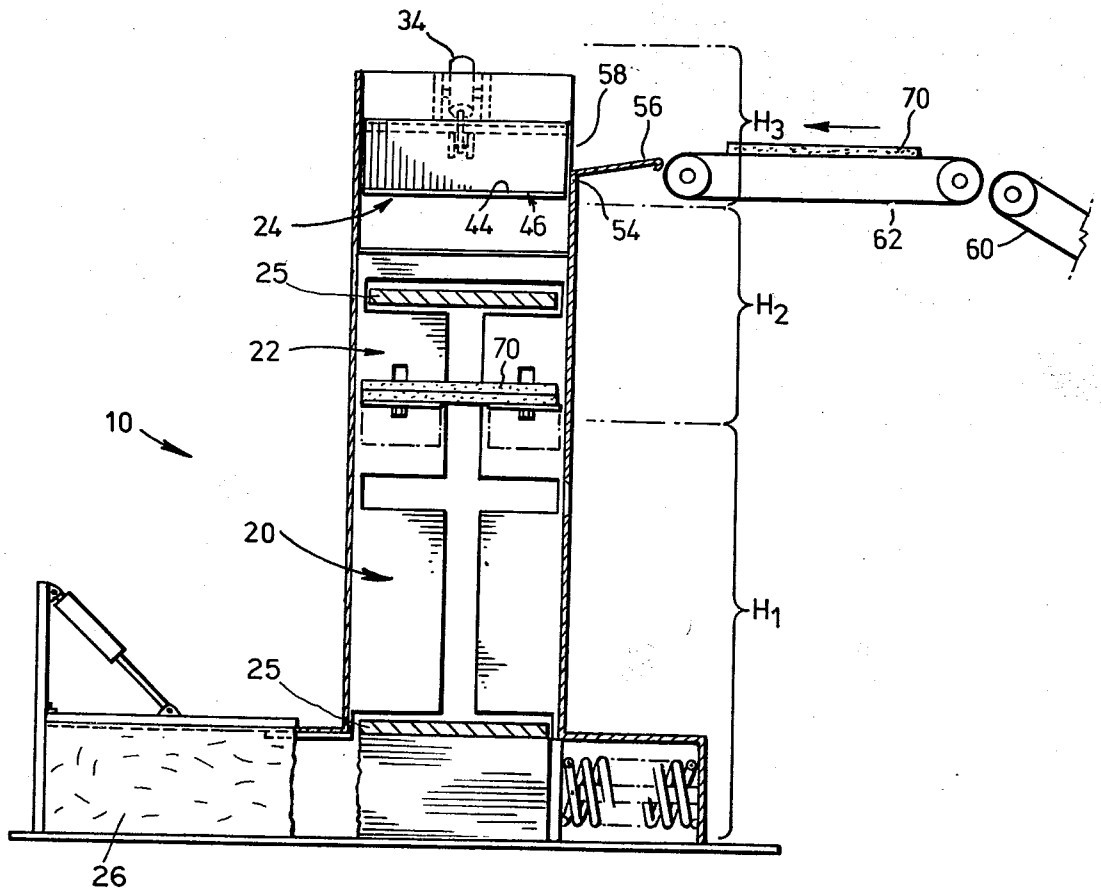
FIG. 1 is a sectioned side view of a batt compressing and packaging machine constructed in accordance with an embodiment of the present invention.
Figure 2:
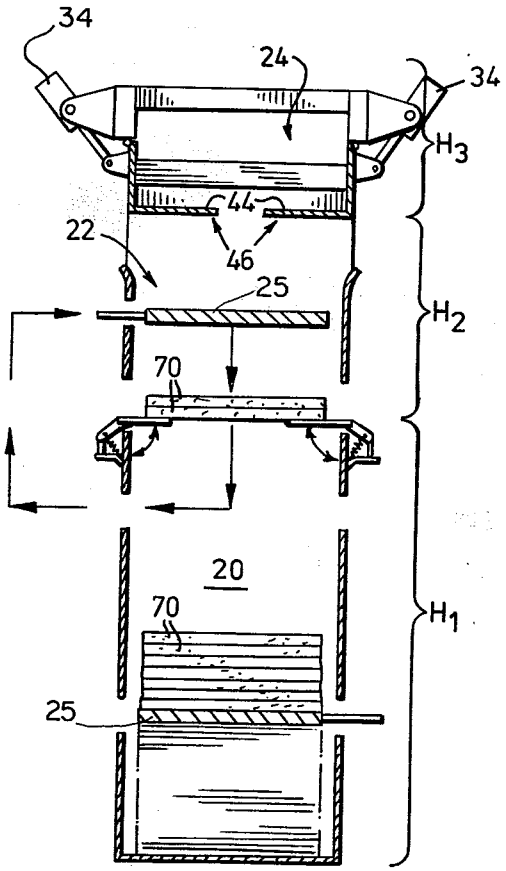
FIG. 2 is a sectional end view of the apparatus of FIG. 1.

With reference to FIG. 1 of the drawings, the reference numeral 10 refers generally to an apparatus for automatically stacking and compressing batts of compressible material such as glass fiber, the major portion of which is described in Canadian Pat. No. 1,013,378 and will not, therefore, be described in detail hereinafter.

The apparatus includes a vertically oriented compression chamber 20 which extends over a height H1, a vertically oriented load accumulating chamber 22 which extends over a height H2 and a vertically oriented load arresting chamber 24 which extends over a height H3. The load arresting chamber 24 is, as will be described hereinafter, provided with gates which are powered so as to be movable between an open and closed position to retain a batt in the load arresting station or to permit the batt to fall from the load arresting station into the load accumulating station.

A pressure and indexing plate 25 enters the load accumulating chamber 22 below the load arresting chamber and is operable as described in U.S. Pat. No. 3,908,539 O'Brien, to transfer an accumulated load from the load accumulating chamber to the compression chamber and to compress the batts within the compression chamber.

Having passed through the load arresting station, batts are accumulated in the load accumulating station and periodically driven out of the load accumulating station 22 into the load compression station to be compressed therein and ejected into a load holding package 26.

Figure 3:
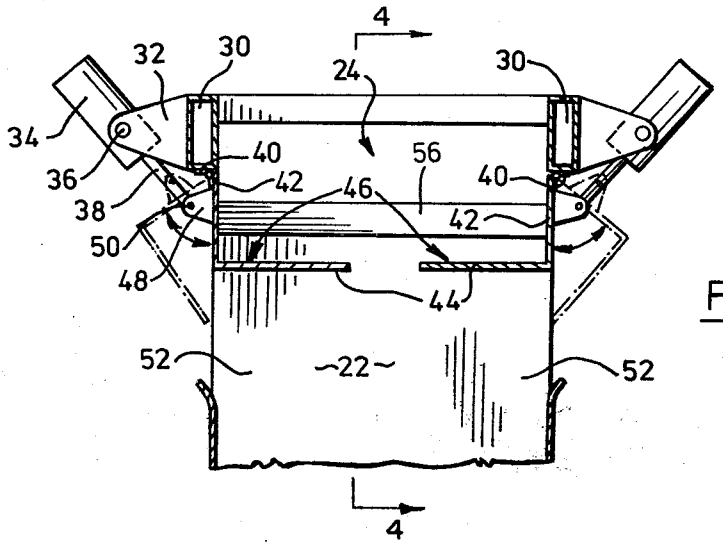
FIG. 3 is an enlarged side view of the upper portion of the apparatus of FIG. 1.
Figure 4:
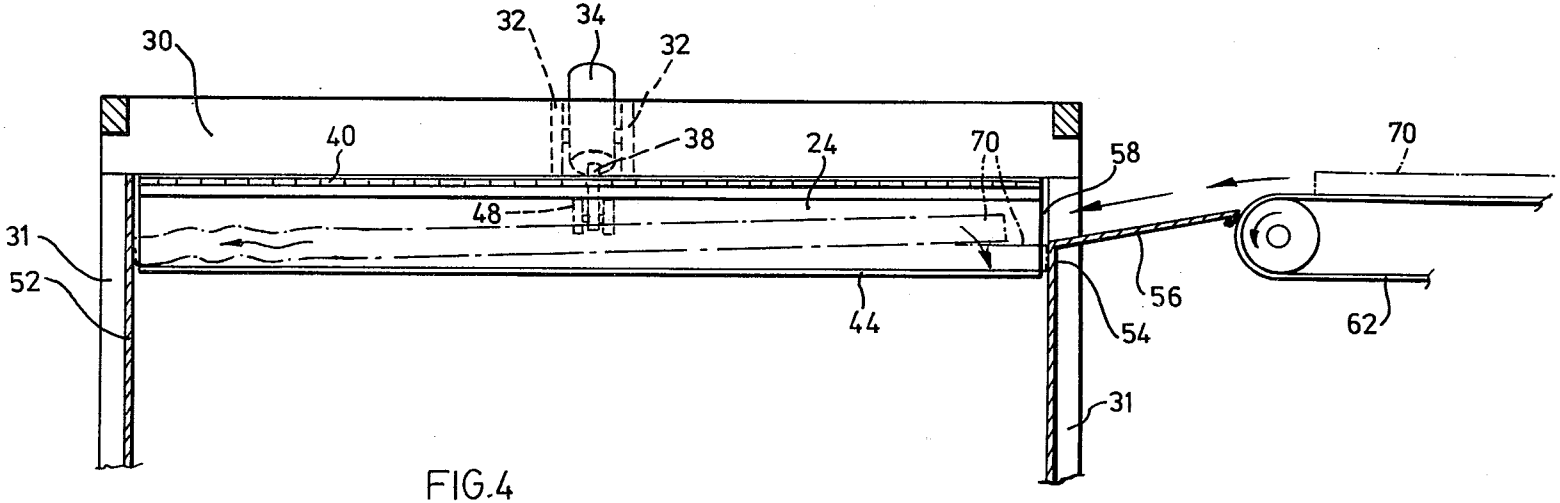
FIG. 4 is a sectional view taken along the line 4—4 of FIG. 3.

With reference to FIGS. 3 and 4 of the drawings, it will be seen that the frame of the machine includes a pair of beam members 30 which are mounted on posts 31 and extend along the oppositely disposed sides of the load arresting chamber 24 at the upper edge thereof. A pair of brackets 32 are mounted on each beam 30 and project laterally outwardly therefrom. A pneumatic cylinder 34 is supported by a pair of shafts 36 which are pivotally mounted in the brackets 32 to permit angular movement of the cylinder 34 with respect to the brackets 32. Each cylinder 34 has a ram 38 projecting therefrom which is operable for movement between an extended position and a retracted position with respect to the cylinder 34. Hinges 40 have one leg secured with respect to the underside of the beams 30 and their other leg secured to a first leg 42 of an L-shaped gate generally identified by the reference numeral 46. Each L-shaped gate 46 has a second leg 44. A pair of brackets 48 are mounted on the legs 42 and are pivotally connected by means of a pivot pin 50 to the outer end of the ram 38. By activating the pneumatic cylinder 34, the gates 46 may be pivoted between the closed position shown in solid lines in FIG. 3 of the drawings and the open position shown in broken lines in FIG. 3 of the drawings. When the gates 46 are in the closed position, the second legs 46 extend laterally inwardly from opposite sides and serve to form a platform on which batts may be supported when located in the arresting station 24. The legs 42 of the gates 46 form together with the beam 36, the side walls of the arresting chamber 24. A wall panel 52 extends between upright support post 31 and forms a front wall which acts as a stop for limiting movement of the batts across the arresting chamber 24. A back stop wall 54 extends laterally inwardly from the posts 31 at a level above the level of the platform formed by the legs 44 and a slide plate 56 projects outwardly and upwardly from the upper edge of the back stop wall 54. An input passage 58 opens inwardly of the frame above the back stop wall 54. Batts may be admitted to the arresting chamber through the input passage 58.

Batts are generally fed to the machine from a main conveyor 60 onto a spacing conveyor 62 which drives the batts one at a time into the load arresting station 24. Preferably the spacing conveyor 62 is driven at a speed which is greater than that of the primary conveyor 60 so that even if the batts are arranged closely adjacent one another on the inclined conveyor, they will be spaced from one another by reason of the acceleration of the leading batt with respect to the next trailing batt as it is transferred by the spacing conveyor 62.

In use, the gates 46 are initially located in the closed position and a batt 70 is driven by the spacing conveyor through the input passage 58 into the load arresting station at a velocity sufficient to ensure that it will be driven along the full length of the arresting chamber 24 to come in contact with the front stop wall 52. By reason of the weight of the batt, it will fall somewhat as it is driven along the arresting chamber 24 so that when it tends to recoil the trailing end thereof will strike the back stop wall 54 which is stationary. Thus, the batt will be brought to rest on the platform formed by the arms 44 of the gate. Thereafter, the pneumatic cylinders 34 are activated to open the gates 46 to permit the batt to fall freely under its own weight into the primary load accumulating station 22.

From the foregoing, it will be apparent that the load arresting chamber of the apparatus of the present invention serves to ensure that all motion of the batts has been arrested before the batts are permitted to fall under their own weight into the secondary load accumulating station and consequently the batts can be carefully and accurately stacked one on top of the other in the load accumulating station.

What I claim as my invention is:

1. An apparatus for stacking and compressing batts of compressible material, comprising:

(a) a vertically oriented chamber having a front wall, back wall and a pair of oppositely disposed side walls, the lower portion of said chamber forming a compression chamber, an intermediate portion of said chamber forming a load accummulating chamber and the upper portion of said chamber forming a load arresting chamber, (b) means adapted to enter said chamber between said accummulating chamber and said load arresting chamber to transfer an accummulated load from said accummulating chamber to said compression chamber, (c) a pair of gates mounted one on each side wall in said load arresting chamber, each gate being mounted for movement between a first position extending laterally from the side wall on which it is mounted into the load arresting chamber in a first horizontal plane to prevent the passage of batts downwardly from the load arresting chamber to the load accummulating chamber and a second position in which said gates are withdrawn from said chamber to permit batts to fall freely into said load accummulating chamber, (d) extensible drive means mounted on said side walls and engaging said gates, said drive means being operable to move said gates to and fro between said extended and retracted positions, (e) an input passage opening through said back wall at a level above said first plane for admitting batts to said chamber along a generally horizontal path which extends toward said front wall, (f) said front wall including a front stop extending above said first plane and disposed opposite said input passage to provide a stop against which batts are driven when loaded into said chamber through said input passage, (g) stationary back stop means at said back wall extending upwardly from said first plane to said input passage to form a back stop to prevent recoil ejection of batts from said chamber through said input passage; and (h) means for feeding batts at high speed along said path and through said input passage means in use.

2. An apparatus for stacking and compressing batts of compressible material comprising:

(a) a vertically oriented load arresting chamber, a vertically oriented load accumulating chamber directly below said arresting chamber and a vertically oriented load compression chamber directly below said accumulating chamber, (b) means adapted to enter said load accumulating chamber below said load arresting chamber to transfer an accumulated load from said accumulating chamber to said compression chamber, (c) a vertically oriented load arresting chamber having a front wall, a back wall and pair of oppositely disposed side walls, (d) a pair of gates mounted one on each side wall, each gate being mounted for movement between a first position extending laterally inwardly from the side wall on which it is mounted into the load arresting chamber in a first plane disposed at the lower end of the load arresting chamber to prevent the passage of batts downwardly into the load accumulating chamber and a second position in which the gates are withdrawn from said first position to permit batts to fall freely from the load arresting chamber to the load accumulating chamber, (e) extensible drive means mounted on said side walls and engaging said gates, said drive means being operable to move said gates to and fro between said extended and retracted position, (f) an input passage opening through said back wall at a level above said first plane for admitting batts to said load arresting chamber along a generally horizontal path which extends toward said front wall, (g) said front wall forming front stop means extending above said first plane to provide a stop against which batts are driven when loaded into said load arresting chamber through said input passage, (h) stationary back stop means at said back wall extending upwardly from said first plane to said input passage to form a back stop to prevent recoil ejection of batts from said chamber through said input passage, (i) means for feeding batts at high speed along said path and through said input passage in use.

* * * * *